US009297179B2

(12) United States Patent
Smith et al.

(10) Patent No.: US 9,297,179 B2
(45) Date of Patent: Mar. 29, 2016

(54) RAZOR WIRE

(71) Applicant: BIRMINGHAM BARBED TAPE LTD., Worcestershire (GB)

(72) Inventors: Ronald Smith, Worcestershire (GB); Steven David Cochrane, Worcestershire (GB)

(73) Assignee: BIRMINGHAM BARBED TAPE LTD., Worcestershire (GB)

( * ) Notice: Subject to any disclaimer, the term of this patent is extended or adjusted under 35 U.S.C. 154(b) by 0 days.

(21) Appl. No.: 14/384,760

(22) PCT Filed: Mar. 15, 2013

(86) PCT No.: PCT/IB2013/000387
§ 371 (c)(1),
(2) Date: Sep. 12, 2014

(87) PCT Pub. No.: WO2013/136164
PCT Pub. Date: Sep. 19, 2013

(65) Prior Publication Data

US 2015/0060748 A1 Mar. 5, 2015

(30) Foreign Application Priority Data

| | | |
|---|---|---|
| Mar. 15, 2012 | (ZA) | 2011/09553 |
| Mar. 18, 2012 | (ZA) | 2012/01757 |
| Aug. 15, 2012 | (ZA) | 2012/06105 |

(51) Int. Cl.

| | |
|---|---|
| ***B21F 25/00*** | (2006.01) |
| ***E04H 17/04*** | (2006.01) |
| ***F41H 11/08*** | (2006.01) |
| ***C22C 21/00*** | (2006.01) |
| ***H01B 1/02*** | (2006.01) |
| ***H01B 3/44*** | (2006.01) |
| ***H01B 7/02*** | (2006.01) |
| ***H01B 13/22*** | (2006.01) |

(52) U.S. Cl.
CPC ..... *E04H 17/04* (2013.01); *B21F 25/00* (2013.01); *C22C 21/00* (2013.01); *F41H 11/08* (2013.01); *H01B 1/02* (2013.01); *H01B 3/44* (2013.01); *H01B 7/0275* (2013.01); *H01B 13/22* (2013.01)

(58) Field of Classification Search
CPC ..... B21F 25/00; C22C 21/00; E04H 17/04; F41H 11/08; H01B 1/02; H01B 13/22; H01B 3/44; H01B 7/0275
USPC ..... 256/6–9, 2
See application file for complete search history.

(56) References Cited

U.S. PATENT DOCUMENTS

| | | | | |
|---|---|---|---|---|
| 3,454,261 | A * | 7/1969 | Nachazel | 256/2 |
| 4,317,955 | A * | 3/1982 | Choi | 174/126.2 |
| 4,509,726 | A * | 4/1985 | Boggs et al. | 256/8 |
| 4,680,573 | A * | 7/1987 | Ciordinik et al. | 340/541 |
| 4,741,594 | A * | 5/1988 | Suzuki | 385/115 |

(Continued)

FOREIGN PATENT DOCUMENTS

| | | |
|---|---|---|
| EP | 0073927 | 3/1982 |
| GB | 2300206 | 10/1996 |

*Primary Examiner* — Gregory Binda
*Assistant Examiner* — Nahid Amiri
(74) *Attorney, Agent, or Firm* — Tutunjian & Bitetto, P.C.

(57) ABSTRACT

Razor wire which includes a core wire, an electrically insulating sheath over the core wire and a strip, with a plurality of barbs, which is crimped, along two lines, on opposing sides of the sheath, positioned so that the sheath is not damaged during the crimping process.

11 Claims, 7 Drawing Sheets

(56) References Cited

U.S. PATENT DOCUMENTS 4,818,972 A * 4/1989 Mainiero et al. ..... 340/566
4,906,975 A * 3/1990 Casella et al. ..... 340/566
5,109,583 A * 5/1992 Pavlov ..... 29/7.1
5,401,002 A * 3/1995 Major ..... 256/2
6,601,830 B1 * 8/2003 Pavlov ..... 256/8
7,325,787 B1 * 2/2008 Gibbs ..... 256/11
7,661,656 B1 * 2/2010 Gibbs et al. ..... 256/6
2003/0099523 A1 5/2003 Pessach et al.

* cited by examiner

RAZOR WIRE

BACKGROUND OF THE INVENTION

This invention relates to barrier wire which can be used for deterrent purposes.

Razor wire, a typical example of barrier wire, includes a high tensile steel core to which a deterrent strip, formed with a plurality of sharp spikes, is secured. This construction, when properly utilised and configured, can present a formidable physical barrier to a would-be intruder.

It is, nonetheless, possible for an intruder to sever razor wire using bolt cutters or the like. This negates the physical effect of the barrier. To counter this type of action it is possible to include a signal wire in the razor wire. If the signal wire is severed an alarm will be sounded. The inclusion of the signal wire does however present certain technical problems.

In most countries, it is not legally permitted to electrify razor wire, or a similar barrier which has a "snagging" effect. If an intruder becomes trapped by electrified razor wire, the intruder may be fatally injured. If a signal wire is used, i.e. a conductor which can operate at a low voltage and current, then some means must be found of insulating the signal wire from the deterrent strip. If the signal wire is used as a direct replacement for the high tensile core wire then, unfortunately, the physical strength of the razor wire is adversely affected to the extent that an intruder can usually simply flatten or push the razor wire aside. On the other hand if a high tensile core wire is insulated then, when the deterrent strip material is crimped onto the core wire, it is not possible to guarantee that the integrity of the insulation will remain unscathed. The crimping force is often so high that the insulation is compressed and can break, and the insulating strip can then contact the core wire. This manifests itself as a short circuit and the capability of this type of razor wire to function as a sensor, which detects severance of the razor wire, is then rendered valueless.

The last-mentioned problem can be overcome, to some extent, by forming the core wire with a robust, thick, insulating sheath. This however can be expensive for it calls for greater quantities of materials.

A different problem presents itself when the razor wire is to be used in a corrosive environment, for example near the sea. The strip which, typically, is made from a thin sheet of steel, is degraded fairly quickly. In order to have a reasonable lifetime the strip should be formed from a corrosion-resistant material such as aluminium. However, when this is done, electrolytic corrosion effects manifest themselves due to the core wire and strip being made from dissimilar metals which are in contact with each other. This phenomenon impacts adversely on the core wire and the strip.

G82300206 discloses an insulating sheath around a conductor but there is no solution mentioned in the specification which addresses the problem of damage which could be caused to the insulating sheath.

U.S. Pat. No. 4,509,726 deals with conventional barbed tape wherein a core wire is noy insulated.

EP0073927 discloses a configuration in which an insulated core is used but with a segmented deterrent strip material.

An object of the present invention is to provide barrier wire which allows for the use of dissimilar metals and wherein the insulating sheath on a core wire its protected.

SUMMARY OF THE INVENTION

Barrier wire which includes a core wire, an electrically insulating sheath which encapsulates the core wire, and an elongate strip which includes a plurality of barb formations at spaced intervals along its length and a plurality of web sections, each barb formation including a barb and a neck portion at a base of the barb, and each web section being located between a respective adjacent pair of barb formations, wherein the strip has two longitudinally extending crimping lines and circumferentially enclosed the core wire, between crimping lines, by an angle and wherein each crimping line is continuous on a respective side of the core wire and passes through the neck portion of each respective barb formation, and through each web section, thereby forming a plurality of flanges with each flange being located between a respective adjacent pair of barb formations: characterized in that the core wire is made from a first metal, the elongate strip is made from a second metal which is different from the first metal in that the sheath prevents a galvanic reaction between the core wire and the strip; and in that that angle is greater than 200° so that the crimp lines do not damage the insulating sheath.

The second mentioned problem i.e. the issues of corrosion due to the effects of the weather, and of electrolytic corrosion are addressed in that the core wire is made from a first metal and is insulated from the elongate strip which is made from a second metal, which is different from the first metal.

The first problem, identified hereinbefore, may be addressed by ensuring that opposing sides of the strip, in between which the core wire is positioned, are deformed that the crimping lines do not exert unduly high forces on the insulating sheath. The sides, upon deformation, are "wrapped" to a substantial extent around the sheath and the core wire. This is opposed to a prior art technique wherein, when the side walls are deformed inwardly, towards each other, the lines along which they are deformed bear directly against the insulating sheath—it is this force which can cause the sheath to collapse and, in this event, the deterrent strip can come into electrical contact with the high tensile core wire.

The core wire can thus, effectively and reliably, be used for conducting a communication signal i.e. an electrical signal in the core wire, for the insulation on the core wire is not adversely affected.

The first metal may be of any appropriate kind and, for example, may be galvanised high tensile steel. The thickness of the core wire may lie in the range of from 1 mm to 3 mm and preferably is of the order of 2.5 mm.

The core wire may have a tensile strength of any appropriate value, for example in the range of 1200 mpa to 1500 mpa.

The sheath may be made from a suitable plastic materials which is weather-resistant. The sheath may for example be formed from PVC. The sheath may be extruded onto the core wire under factory conditions.

The thickness of the sheath may lie in the range of from 0.2 mm to 0.6 mm and typically is of the order of 0.4 mm.

The aforementioned numerical values are exemplary, and are non-limiting.

The second metal may include aluminium. The second metal may be an aluminium alloy. Alternatively or additionally a strip of aluminium may be mechanically processed so that it is work hardened. This step ensures that the barb formations on the strip, which are formed, for example, by means of a pressing or die operation, have substantial rigidity and thus exhibit a desired deterrent effect. The use of an aluminium strip, as opposed to a steel strip, significantly reduces the weight of the barrier wire.

The strip may have any appropriate width and the barb formations may be spaced from one another along the length of the strip by a suitable distance. The invention is not limited in this respect.

The strip may have a thickness in the range of 0.2 mm to 0.6 mm and preferably has a thickness of the order of 0.4 mm.

The barrier wire may be formed into a concertina coil or into a so-called "flat wrap" configuration or into any other suitable configuration. The invention is not limited in this respect. However, when adjacent coils of the barrier wire are secured to each other, use is preferably made of a material which is compatible with the strip material so that galvanic corrosion effects do not manifest themselves at points at which adjacent coils are secured to each other. Use is, for example, made of clips which are made from the second metal (when the metal is used for the strings). In the aforementioned example the clips are then preferably made from aluminium or an aluminium alloy.

In this specification the expressions "barrier wire" and "razor wire" are used interchangeably.

BRIEF DESCRIPTION OF THE DRAWINGS

The invention is further described by way of examples with reference to the accompanying drawings in which.

DESCRIPTION OF PREFERRED EMBODIMENTS

Figure 1:
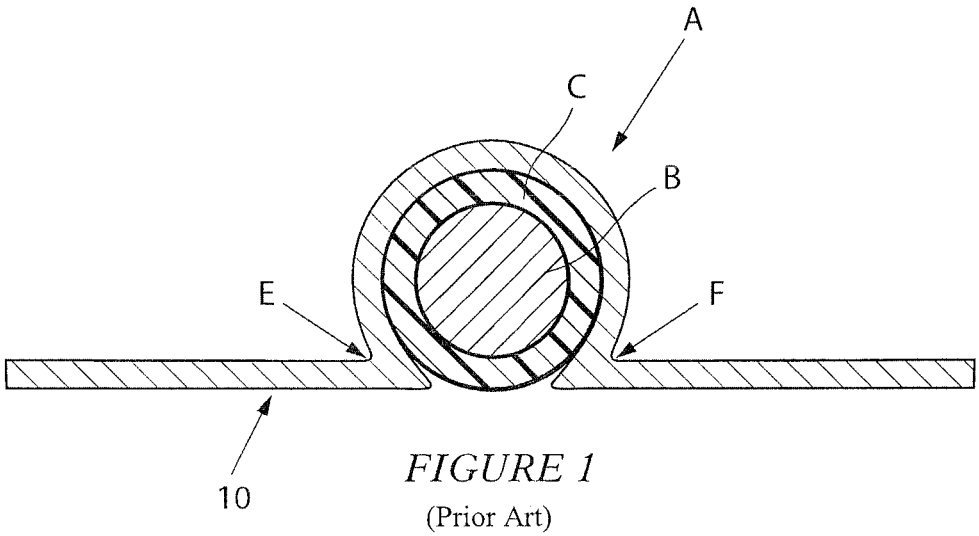
FIGURE 1 (Prior Art)
FIG. 1 is a view in cross-section of prior art barrier wire.

FIG. 1 of the accompanying drawings is a cross-sectional view of barrier wire A according to a prior art configuration.

The barrier wire includes a metallic core B surrounded by an insulating sheath C. A deterrent strip D, of a configuration known in the art, is crimped onto the core wire and the insulation. The crimping takes place along opposed lines E and F. At these lines stress zones are produced, inside the insulation, as the strip material is urged towards the core. If the insulation is not strong or thick enough it is prone to collapse in these zones and, as a consequence, the deterrent strip material can come into electrical contact with the core wire B. The invention is intended to address this problem.

Figure 2:
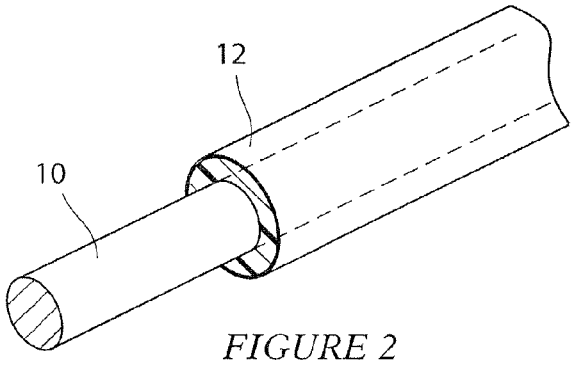
FIG. 2 is a perspective view of a coated core wire used in the fabrication of barrier wire i.e. razor wire according to the invention.

FIG. 2 of the accompanying drawings illustrates in perspective a length of core wire 10 which is used in making razor wire according to the invention. The core wire is a galvanised high tensile steel wire with a nominal diameter of 2 mm and a tensile strength which is in the range of 1200 mpa to 1500 mpa. Under factory conditions polyvinyl chloride (PVC) is extruded onto the core wire 10 to form a continuous insulating sheath 12 over the wire. During the extrusion process a hot melt of PVC is placed over the moving core wire and is then allowed to solidify in situ around the core wire 10. An external diameter of the sheath is of the order of 2.8 mm. The PVC is a good electrical insulator.

Figure 3:
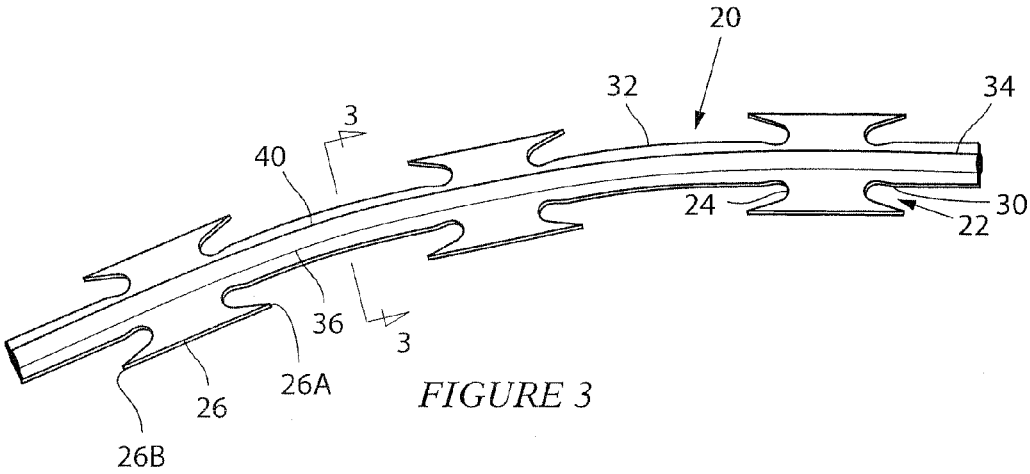
FIG. 3 illustrates in plan a length of barrier wire according to the invention.
Figure 4:
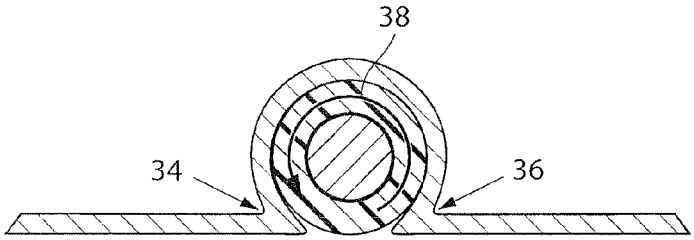
FIG. 4 is a view in cross-section of the razor wire taken on a line 3-3 in FIG. 2.

Referring to FIGS. 3 and 4 a strip 20 of high tensile aluminium or of an aluminium alloy which, possibly, is work-hardened, is processed so that the strip on each longitudinal edge has a respective plurality of barb formations 22 at spaced intervals along its length. Each barb formation has a neck portion 24 and a barb 26 in the form of two spikes 26A, 26B. The neck portion 24 is at a base 30 of the barb 26. The strip has a plurality of web sections 32, each of which is located between a respective adjacent pair of barb formations 22.

Thereafter, using suitable equipment (not shown), the strip 20 is run parallel to the core wire 10 and the sheath 12, and the strip is crimped along two crimping lines 34, 36, which are roughly on opposing sides of the core wire, so that a central portion of the strip encloses the sheath through an angle 38 which is of the order of 200°, or slightly more (see FIG. 4). The strip is thereby securely fixed to the sheath.

Each crimp line is continuous and passes through the respective web sections 32 thereby to form flanges 40 from the respective web sections, and through the respective neck portion 24 of each barb formation 22.

The applicant has found if each crimp line is discontinuous i.e. does not traverse each web section and passes only through the neck portion of each barb, that a zone of weakness is created in each neck portion with the result that the barbs can then easily be broken off from the remainder of the strip. This problem is for practical purposes eliminated when the crimping line is continuous and passes through the respective web sections as well as through the neck portion of each respective barb formation.

The sheath 12, which is made from an electrically insulating material, isolates the strip 20 from the core wire 10. The strip and core wire are made from dissimilar metals and, in the absence of the intervening insulating sheath, the strip and core wire would directly contact each other and this would give rise to electrolytic corrosion effects.

The aluminium strip is weather-resistant to a substantial extent and is well-suited for use in locations which are near the sea and in similar environments. The core wire, although made from steel, is protected from environmental corrosion effects by means of the sheath.

The razor wire of the invention can be used in any appropriate way. The barb formations, which are formed from high tensile aluminium, are rigid and do not bend easily. The deterrent effect of the barb formations is therefore retained.

Figure 6:
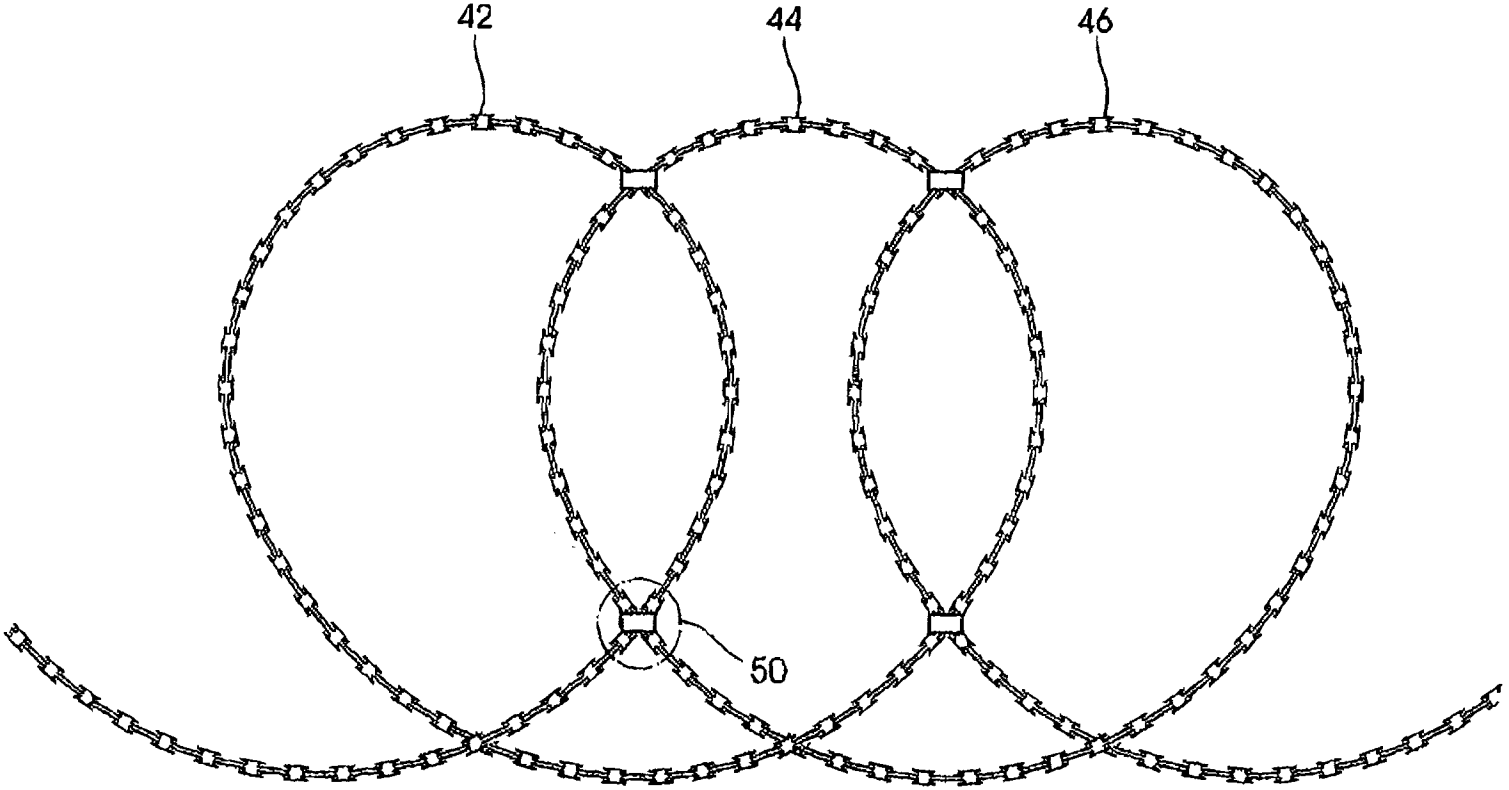
FIG. 6 shows so-called "flat wrap" which is made from razor wire according to the invention.

FIG. 6 illustrates one possible usage of the razor wire in which adjacent coils 42; 44; 46 . . . are secured to one another at locations 48, by means of clips 50. Each clip is made from a material, e.g. aluminium, which is compatible with the material of the strip. Thus galvanic effects do not arise between the clips and the strip.

Figure 7:
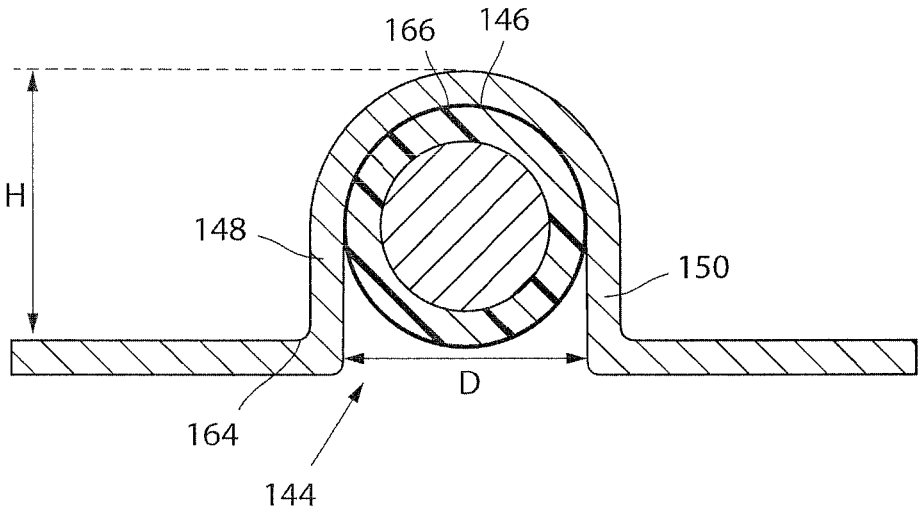
FIG. 7 is a view in cross-section of barrier wire at an interim stage of manufacture.
Figure 8:
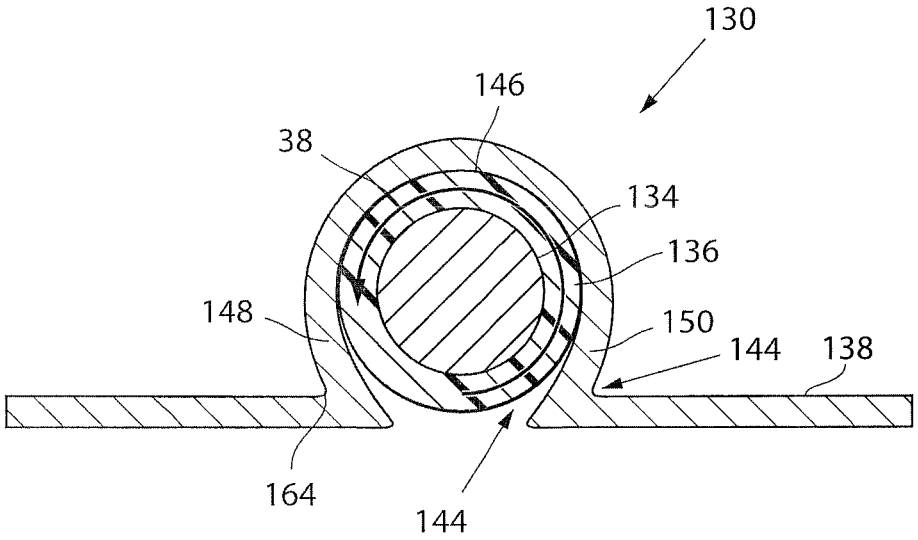
FIG. 8 is a view in cross-section of barrier wire made according to the principles of the invention.
Figure 9:
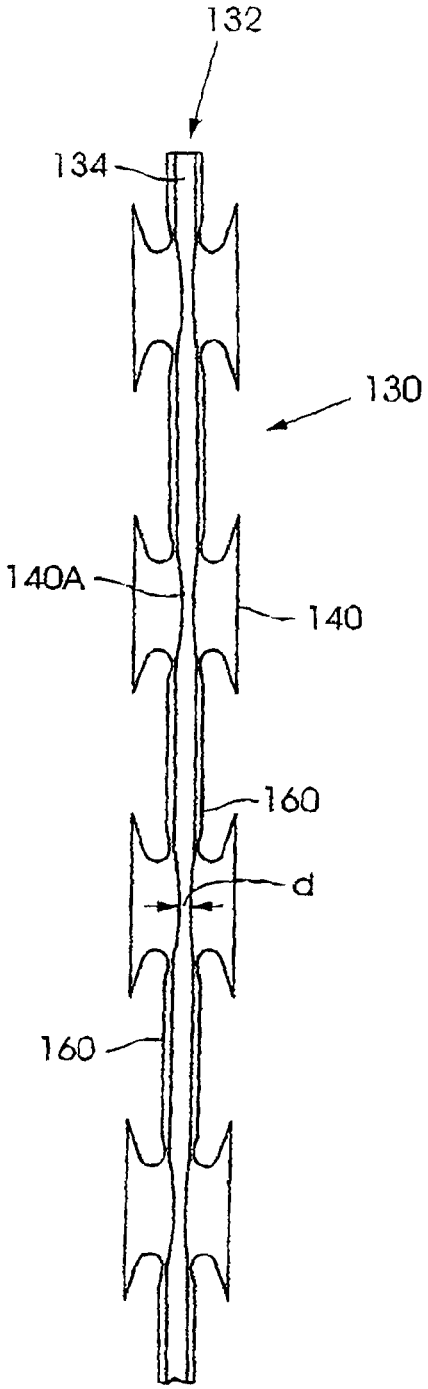
FIG. 9 illustrates from one side the barrier wire shown in FIG. 8 but on a reduced scale.

FIG. 8 illustrates, in cross-section, barrier wire 130 according to a variation of the invention. FIG. 9 shows the barrier wire 130 from one side but on a reduced scale. The barrier wire includes an elongate central component 132 comprising a core 134, made from high tensile steel, an elongate electrically insulating sheath 136 which encases the core, and an elongate strip 138 of deterrent material made, for example, from galvanised sheet metal. The strip 138 is formed with a plurality of sharp barbs 140 at regular intervals along the length of the strip—see FIG. 9. Initially the strip has a deep channel 144 comprising a base 146 and opposed side walls 148 and 150 respectively which are parallel to each other and which are spaced apart by a distance D—see FIG. 7. The barbs 140 project outwardly from the walls 148 and 150. Shallow flanges 160 (see FIG. 9) are located between adjacent pairs of barbs 140 on opposed sides of the central component 132.

The cross-sectional dimension D is effectively the same as the maximum cross-sectional dimension of the central component 132 (i.e. of the core wire and the insulation). Each side wall 148, 150, has a height H measured from a junction 164 of the side wall with a corresponding flange or barb and an innermost point 166 of the base 146. H is greater than D.

During manufacture of the barrier wire the central component 132 is located deeply inside the channel and bears against the inner surface of the base 146 and is in close contact with opposing inner surfaces of the walls 148 and 150. In a subsequent metal working operation the junctions 164 are urged inwardly, towards each other, see FIG. 8. When this occurs the material of the side walls is "folded over" onto an outer surface of the insulation 136. The strip material is not deformed in a manner which compresses a portion of the insulation between the junctions 164 and the core wire 134. No undue stress is therefore exerted on the insulation.

Preferably the base 140A of each barb 140 is folded inwardly, to reduce the dimension D, at this region, to a smaller dimension d and the narrow flange sections 160 are not folded inwardly. This technique is shown in FIG. 9. This helps to eliminate stress from being placed on the insulation. In effect therefore the channel in the strip material is made deep enough to accommodate the central component and the strip material is then deformed inwardly at successive locations which correspond with the positions of the barbs. The strip material is thus fixed to the central component at a plurality of locations spaced along the length of the strip material.

The invention can thus be implemented in different ways to suit requirements. In all cases care is taken to avoid the production of excessive stress in the insulation. The strip is applied through an angle 38 (FIG. 4) which is, at least, 200°. In FIG. 8 the angle 38 is of the order of 270°.

Figure 5:
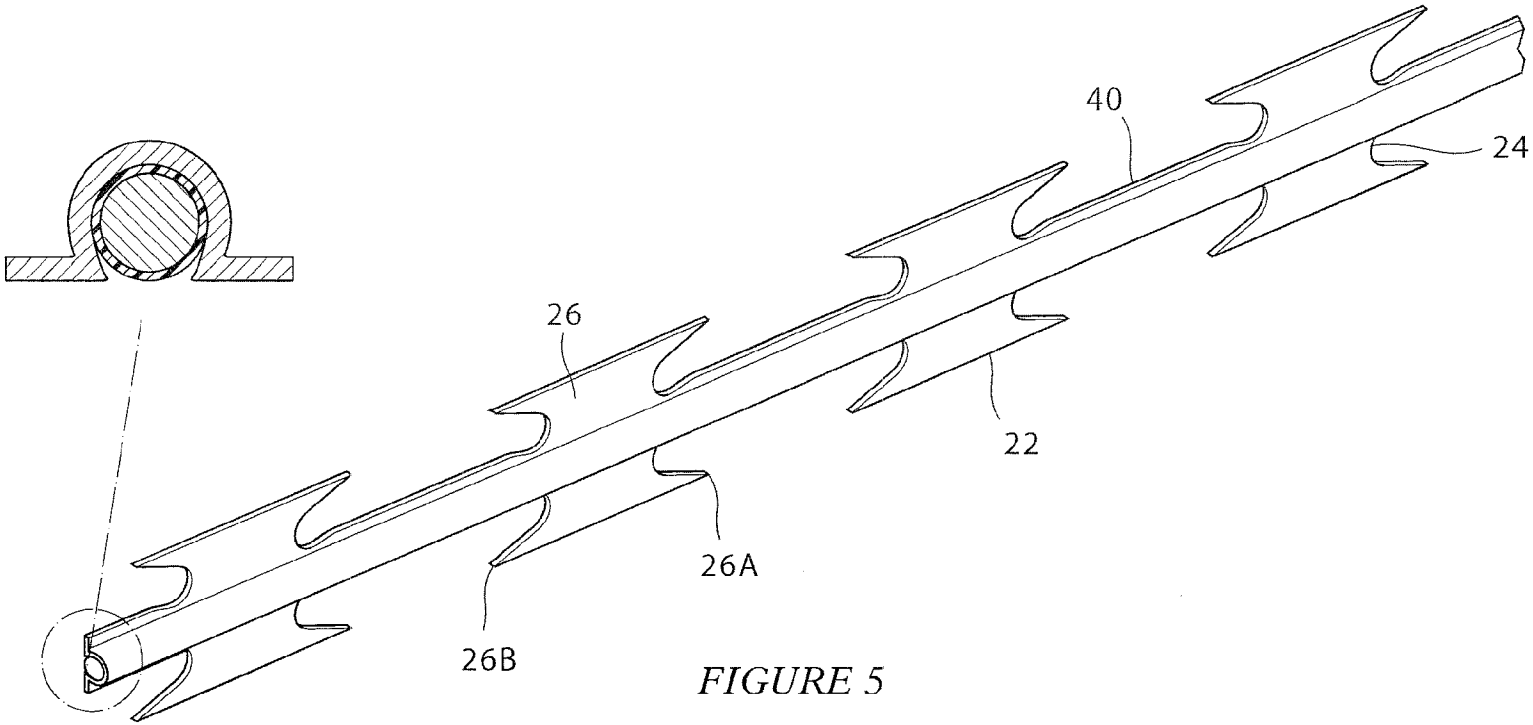
FIG. 5 illustrates in perspective a length of razor wire according to the invention.

If the strip is made from a material such as aluminium the overlap lines 34, 36 (FIG. 4) and 164, 166 (FIG. 7) do not "isolate" successive barbs from one another but pass through the remote pieces which are between adjacent barbs and so form relatively small flaps (32, FIG. 5; 160, FIG. 9) which stiffen the end product.

The invention claimed is:

1. A barrier wire which includes a core wire which is made from a first metal, an electrically insulating sheath which encapsulates the core wire, and an elongate strip which is made from a second metal which is different from the first metal, the electrically insulating sheath preventing a galvanic reaction between the elongate strip and the core wire, the elongate strip including a plurality of barb formations at spaced intervals along a length of the elongate strip and a plurality of web sections, each barb formation including a barb and a neck portion at a base of the barb, and each web section being located between a respective adjacent pair of barb formations, wherein the elongate strip has two longitudinally extending crimping lines and circumferentially encloses the core wire, between the crimping lines, by an angle and wherein each crimping line is continuous on a respective side of the core wire and passes through the neck portion of each respective barb formation, and through each web section, thereby forming a plurality of flanges with each flange being located between a respective adjacent pair of barb formations, and wherein, so that the crimping lines do not damage the insulating sheath, the angle is greater than 200°, opposing sections of the elongate strip material are folded inwardly, towards each other, at successive locations which respectively correspond with positions of the plurality of barb formations, and the plurality of flanges are not folded inwardly.

2. The barrier wire according to claim 1 wherein the core wire is galvanized high tensile steel.

3. The barrier wire according to claim 1 wherein the core wire has a thickness of between 1 mm and 3 mm.

4. The barrier wire according to claim 1, wherein the core wire has a tensile strength in the range of 1200 mpa to 1500 mpa.

5. The barrier wire according to claim 1, wherein the sheath is made from a weather-resistant plastics material.

6. The barrier wire according to claim 1, wherein the sheath is formed from PVC.

7. The barrier wire according to claim 1, wherein the sheath has a thickness in the range of 0.2 mm to 0.6 mm.

8. The barrier wire according to claim 1, wherein the elongate strip is aluminum, or an aluminum alloy, which has been work-hardened.

9. The barrier wire according to claim 1, wherein the elongate strip has a thickness in the range of 0.2 mm to 0.6 mm.

10. The barrier wire according to claim 1, wherein said angle is greater than 270°.

11. A concertina coil having a plurality of coils of razor wire, comprising:

a barrier wire according to claim 1, wherein adjacent coils are secured to one another by a respective member which is made from the second metal.

* * * * *